US005240249A

United States Patent [19]

Czarnecki et al.

[11] Patent Number: 5,240,249

[45] Date of Patent: Aug. 31, 1993

[54] CARD GAME APPARATUS

[76] Inventors: Edward M. Czarnecki, 426 Sinclair Street, Winnipeg, Manitoba, Canada, R2X 1Y1; Alan J. Ross; Diane Brophy-Ross, both of 83 Garwick Cove, Winnipeg, Manitoba, Canada, R2J 4C2; William R. Foster, 1264 Chamberlain Avenue, Winnipeg, Manitoba, Canada, R2X 1E7

[21] Appl. No.: 884,122

[22] Filed: May 18, 1992

[51] Int. Cl.[5] ..... A63F 9/00; A63F 1/00

[52] U.S. Cl. ..... 273/85 CP; 273/85 G; 273/237; 364/412

[58] Field of Search ..... 273/85 CP, 85 G, 237, 273/274, 292, 138 A, DIG. 28; 364/412

[56] References Cited

U.S. PATENT DOCUMENTS

| | | | |
|---|---|---|---|
| 3,420,526 | 1/1969 | Berger | 273/148 R |
| 3,735,982 | 5/1973 | Gerfin | 273/85 G |
| 4,193,600 | 3/1980 | Armstrong et al. | 273/148 R |
| 4,245,216 | 1/1981 | Rintoul | 273/148 R X |
| 4,614,342 | 9/1986 | Takashima | 273/85 CP |
| 4,760,527 | 7/1988 | Sidley | 273/85 CP X |
| 4,799,683 | 1/1989 | Bruner | 273/85 CP X |
| 5,022,653 | 6/1991 | Suttle et al. | 273/85 CP |

FOREIGN PATENT DOCUMENTS

| | | | |
|---|---|---|---|
| 2067080 | 7/1981 | United Kingdom | 273/85 CP |
| 2177610 | 1/1987 | United Kingdom | 273/85 CP |

*Primary Examiner*—V. Millin
*Assistant Examiner*—Sebastiano Passaniti
*Attorney, Agent, or Firm*—Adrian D. Battison; Stanley G. Ade; Murray E. Thrift

[57] ABSTRACT

An electronic game apparatus for playing a card game and particularly the card game cribbage includes a central unit and a plurality of player units separate from but attached to the central unit for communication therewith. The central unit can store indicia relating to the set of cards of the conventional nature and can transfer those cards to different display areas on the main board and on the playing units. Each player can operate transfer buttons on the player unit which act to transfer selected ones from the cards indicated on his player unit to the required location on the main board for the playing of the game cribbage. The main unit calculates the score and enters this on a conventional cribbage scoreboard.

2 Claims, 2 Drawing Sheets

CARD GAME APPARATUS

BACKGROUND OF THE INVENTION

This invention relates to an apparatus for playing a card game and particularly but not exclusively the card game of Cribbage.

Cribbage is a very well known game that has been widely played in many countries for very many years and is based upon a conventional pack of cards of the type including four suits with thirteen cards in each suit from the Ace through to the King.

The game is based upon complex rules and calculations based upon the presence of various patterns in the cards dealt to each player.

For the convenience of the reader, the following information which is of course public knowlege is provided concerning the details of the game of Cribbage.

Cribbage is one of the oldest card games in existence today. The board used for scoring in cribbage was evidently adapted from earlier dice-game scoreboards and the rules of the play seem to owe much to an old English game called "Noddy". The invention of cribbage has been popularly accredited to the english poet and courtier Sir John Suckling, who lived from 1609 to 1642. Early english settlers brought cribbage to America, where its popularity still endures, especially in New England. Modern six-card cribbage is basically a two handed game, but it can also be played three-handed and four-handed, partnership style, Played either with or without stakes, two handed cribbage is a fast, absorbing game.

1. The players and the cards. Two players, using a standard 52 card deck. Ace is low (1 point), King is high. Picture cards and tens are worth 10 points, the other cards retain their face value.

2. The deal. Each player cuts the deck. Low draw deals six-card hands, one at a time. The remaining cards go face down as a stock, which is placed next to the scoring board.

3. The crib. After the cards have been dealt, each player selects two cards from his hand and places them face down to the dealer's right. These four cards are known as the crib and form an extra hand that belongs to the dealer but is not used while the hand is played. At the end of the hand, the crib is added to the dealer's score.

4. The board. Score is kept on a special cribbage board. There are four rows of 30 holes, two rows for each player, and usually there are additional game holes at one or both ends of the board. Each player has two pegs (each pair of a different color, usually black for one player and red for the other) and each player moves his pegs up the outer row and down the inner on his side of the board. When there are four game holes, the players put their pegs in them for the start of the play. To mark his first score, the player moves one peg that number of holes from the start.

His second score is marked by placing his second peg that number of holes beyond his first peg. He marks his third score by placing his first peg that number of holes beyond his second peg, and so on.

5. Object of the game. The objective is to score 121 points.

6. Scoring during play. Before cribbage can be played seriously and enjoyably, the players must be aware of the scoring during play, as the credits to be accumulated are the basis of all strategy and tactics.

7. The play. Nondealer cuts the stock and dealer picks up the top card of the lower part of the deck. Nondealer puts the top half of the stock back and dealer places the card face up on top of stock. This is the starter and will be used at the end of the hand, when both players tally their scores. Nondealer chooses one of the four cards in his hand, places it face up on the table directly in front of him and calls its value. Dealer now also lays down a card and calls out the total value of his card plus his opponent's. (On all subsequent plays, the total value of the card played is called out) On this play, dealer tries either to match his opponent's card and make a pair or to add to it so that the total is 15. (If he succeeds, he advances his peg two holes for two points) The nondealer, in his turn, now attempts to build on the cards already played. Besides trying for a 15 or a pair, each player can now try for other combinations. For example, if a pair was scored and the next player is able to lay down a third card of the same rank, he will score for a royal pair, etc.

A sequence of cards scores regardless of the order in which it is played. Thus, if cards are played in the order Ace, 2, 5,4,3 the player putting out the 3 can count a run of five cards. Should the second player be able to lay down a 6, he can count a run of six cards, etc..

The players continue to lay down cards in turn as long as the total value of the cards does not exceed 31. If a player at his turn is unable to play a card that is within the limit of 31, he says "Go". His opponent then plays any of his cards that are low enough to be within the limit. If they make 31 he scores two points, if less than 31 he scores one point and also says "Go". When the count during play reaches 31, the cards are turned face down to prevent confusion. The remaining cards in hand are played, the called score starting with the next card. Play continues until all the cards are played or until another 31 limit is reached. The player discarding the last card in the hand wins a point, or two points if he is able to score 31 with the last card.

8. Scoring in showing. In cribbage, the melds are scored after the play of the hand. That is, all the cards in a player's hand are tallied for the scoring combinations possible. (This score is then added to whatever is already pegged on the board.) In scoring, the starter is considered the fifth card in each hand. There are slight variations in scoring double, triple and quadruple runs, depending on where the game is played. This method is the one most commonly used in the USA.

Nondealer shows and scores first, which gives him an advantage if he is very near reaching 121. Each score should be announced by name and points so the opponent can verify it.

After the nondealer has declared his score, the dealer shows and scores his own hand. The crib is scored in the same way as the hands, except that the only flush allowed is a five-card one. The deal alternates between the players from hand to hand. After each hand, the cards are shuffled. The loser of a game deals first in the next game.

Cribbage therefore has the advantage that it can be played very simply by two players with the simple equipment of a board and a pack of cards. It gives endless pleasure to many persons.

It does however have a number of disadvantages. Firstly the game requires the players to calculate and enter the scores obtained during play and during melding. Many players have difficulty with calculating their score and make errors or omissions so that this aspect can in some cases be considered to be a tedious chore involved in the game.

Secondly the game cannot be played by a single person.

Thirdly the rather old fashioned scoring system of a board and peg is unwieldy and often leads to damaged or lost pegs.

Attempts have been made to develop electronic scoring systems in which the pegging is avoided but this simply involves an arrangement in which the players must enter their score into a keyboard on the scoring device so that the scoring device simply translates the score into the conventional pegging system. This does not of course obviate the necessity for calculating the score.

Computer programs have been generated for playing cribbage against the computer in which the computer can be used to calculate the scores. However these programs are basically useful only for persons interested in computers since the program uses the conventional computer keyboard and input systems. Interest in computers is limited to only a relatively small segment of society and often not the same people who are interested in playing cribbage.

SUMMARY OF THE INVENTION

It is one object of the present invention, therefore, to provide an apparatus for playing a card game particularly cribbage which allows electronic calculation of the score and comprises a dedicated electronic device which enables playing of the game using relatively straight forward commands and switches.

According to the first aspect of the invention there is provided an apparatus for playing a card game comprising a central unit, a plurality of player units each having means for connection to the central unit and being separate from the central unit for handling by a respective one of a plurality of players of the card game, said central unit including a processor control means having means for storing indicia representative of each of the cards of a set of cards, each of said player units including display means for displaying a plurality of said cards selected from the full set of the cards, said processor control means including means for manipulating the indicia of the set of cards and for shuffling the set into a substantially random order and means for dealing the indicia representing individual cards from the set in said random order so as to be displayed onto the display means of each of said player units, with each player unit having displayed thereon different ones from said set and manually operable switch means operable by each of the players for transferring selected ones of the displayed indicia from the respective player unit to the central unit for storage thereon.

According to a second aspect of the invention there is provided an apparatus for playing the card game Cribbage comprising a central unit, a plurality of player units each having means for connection to the central unit and being separate from the central unit for handling by a respective one of a plurality of players of the card game, said central unit including a processor control means having means for storing indicia representative of each of the cards of a set of cards, each of said player units including display means for displaying a plurality of said cards selected from the full set of the cards, said processor control means including means for manipulating the indicia of the set of cards and for shuffling the set into a substantially random order and means for dealing the indicia representing individual cards from the set in said random order so as to be displayed onto the display means of each of said player units, with each player unit having displayed thereon different ones from said set and manually operable switch means operable by each of the players for transferring selected ones of the displayed indicia from the respective player unit to the central unit for storage thereon, said central unit including a cribbage scoring board having electronic display means thereon for displaying the cribbage score of the players, said central unit including a first display means thereon for displaying a plurality of indicia indicative of the cards from the set transferred from the player units and arranged to constitute the "Crib" of the cribbage game and a plurality of second display units each for displaying a transferred selected one of the displayed indicia from the respective player units, each of the second display means being associated with a respective player unit, said manually operable switch means including a first crib switch operable to transfer a selected one of the displayed indicia from the respective player unit to said first display means, a second play switch operable to transfer a selected one of the displayed indicia from the respective player unit into the respective second display means and a third deal switch operable to actuate said dealing means, and means for calculating according to the rules of cribbage the score for each player during play and the score for each player during melding of the indicia displayed on each player unit and means for displaying said calculated score on said cribbage scoring board.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
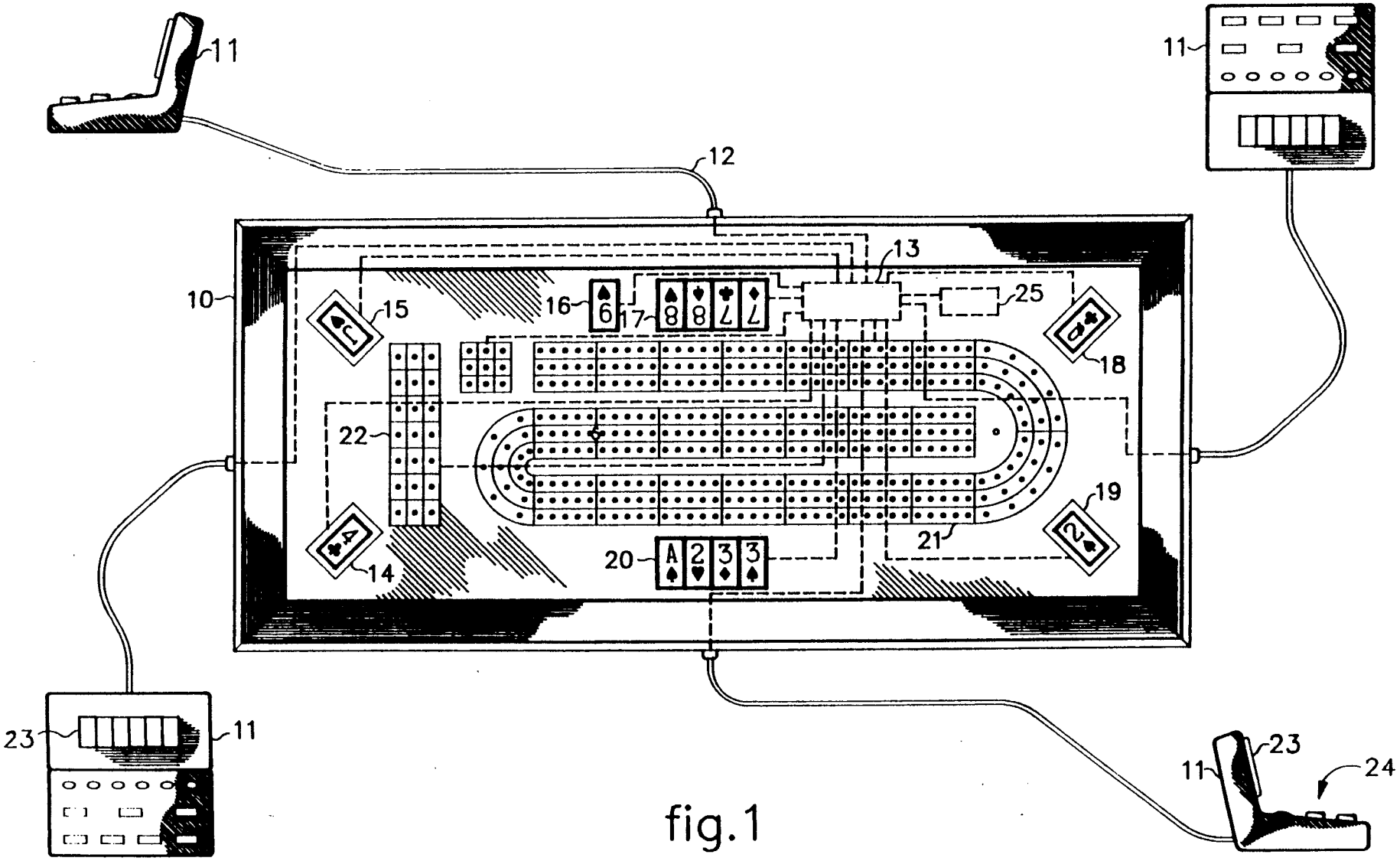
FIG. 1 is a schematic view showing an apparatus according to the present invention including a central unit and four individual player units attached to the central unit for cooperation in the game.

As shown particularly in FIG. 1, the apparatus comprises a central unit 10 and a plurality of individual player units 11. Each player unit includes a connecting cord 12 for communicating electronically with the central unit in two way communication so that each player unit is connected to a central processor 13 of the main central unit by communicating wires indicated schematically. The central processor unit as well as communicating with the individual player units also communicates with a plurality of display devices 14, 15, 16, 17, 18, 19 and 20 on the main central unit all of which are visible on a top surface of a central unit. The central unit further includes a scoreboard 21 which is for esthetic and convention reasons shaped in the manner of the conventional cribbage scoreboard so as to allow the player to follow the track of the score in the usual shape up to the conventional winning point. Furthermore the central unit includes a second unit scoreboard element 22 associated with the first scoreboard element and arranged for scoring the number of games won by the individual players.

Each player unit comprises a further display 23 together with a plurality of player operable buttons generally indicated at 24. The central processor unit 13 is connected to a memory unit 25 which is arranged for storing indicia indicative of the individual cards of the set of conventional cards including the four suits each containing thirteen cards of the type well known and well used in the game of cribbage.

Figure 2:
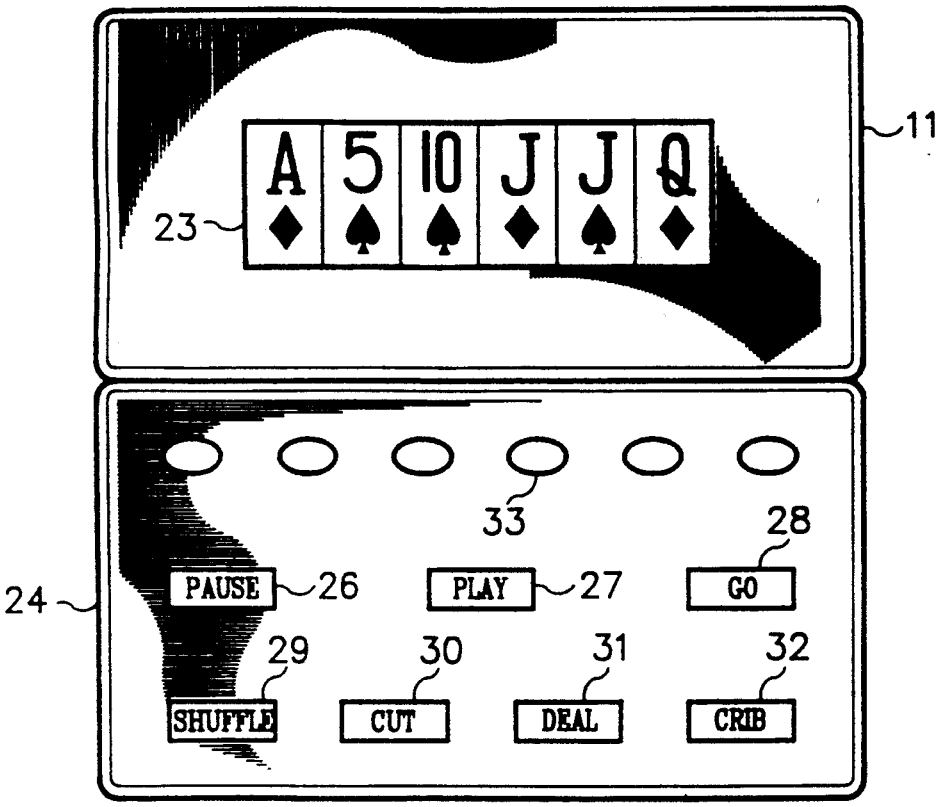
FIG. 2 is a plan view of one of the player units.

Each display area on both the main unit and the player units includes means for displaying the indicia of individual ones of the cards from the set stored in the memory unit. Some of the display areas are arranged to display only a single card while others are arranged to display a plurality of the cards side by side. Thus each player unit includes six such display areas arranged in side by side orientation each able to display, as shown in FIG. 2, a respective one of the indicia indicative of a card from the set. As shown in FIG. 1 the display areas 14, 15, 16, 18 and 19 each comprise a single display area. The display areas 17 and 20 each include four such display areas arranged side by side.

Each of the player units includes the manually operable playing buttons indicated at 24 and these include seven such buttons. These are identified as a "pause" button indicated at 26, a "play" button indicated at 27, a "go"button indicated at 28, a "shuffle" button indicated at 29, a "cut" button indicated at 30, a "deal" button indicated at 31 and a "crib" button indicated at 32. In addition the player unit includes means for indicating a respective one of the six display areas. There are two possibilities for indicating the display areas. In a first arrangement, the display areas are indicated by a series of indicator elements 33 so that a required one of the display areas can be selected by moving an indicator from each of the display areas to the next until a selected one is reached. Alternatively the elements indicated at 33 can comprise press buttons which allow the direct communication by the player to the device of the selected display area.

The central processing unit is arranged so that it can effectively shuffle the cards stored in the memory unit so as to place the indicia relating to the cards in a substantially random order. Secondly the central processing unit 13 can arrange to transfer each indicia relating to a card to the required one of the display areas under control of the play button 24 of the players. Thirdly the control unit 13 can calculate the score allocated to each player for each aspect of the game both in the normal play and in the subsequent melding of the hands. Fourthly the central processor can indicate on the display area on the main board associated with the player unit which player is required to play next. In a preferred technique on the main board, the display for this prompt feature is comprised of an illuminatable surround portion surrounding the respective display area associated with each player.

In playing of the game, each player in turn presses the cut button 30 following which the microprocessor unit acts to supply randomly to each of the display areas 14, 15, 18 and 19 which are associated respectively with the player units 11. The player unit with the highest or lowest card randomly selected is then appointed as the dealer.

After the dealer is selected, the appointed dealer presses the deal button 31 following which the microprocessor 13 acts to randomly transmit the indicia relating to the cards to each of the player units until each of the six spaces at each of the player units which are engaged are filled with the indicia. The unit 13 then acts to again cut the cards and apply an uppermost one or selected one of the cards into the display area 16 as the card for use in the playing round of the game.

The unit 13 then communicates to the prompt feature on the main board with the first turn in the play round to indicate that the play is with that unit. In accordance with the conventional rules of cribbage, therefore, the player selects the two cards that he wishes to discard by indicating the area concerned from the display area 23 by use of the system indicated at 33 and then presses the crib button 32 to transfer those two cards to the area 20. Subsequently the other players carry out the same process so that the crib display area 20 is filled.

According to the rules of cribbage, the crib is maintained covered until the later stage in the game. The display area 20 is therefore arranged so that initially the indicia transmitted to that area are maintained covered or undisplayed until this is required later in the game. In the preferred arrangement the unit 13 stores an indicium indicative of a rear surface of a card and displays this in the display area while waiting for the required time for the cards to be displayed.

During normal play, the turn of each player is indicated by the prompt feature on the main board. The player concerned can therefore press one of the three buttons indicated at pause, play and go respectively depending upon the step that he requires to be carried out. If a less experienced player wishes to delay the game slightly to apply some thought, he can press the pause button 26. If the player wishes to place a card onto the main board, this is carried out by pressing the play button 27 in association with an indication of the required card to be played by actuating the system 33. If the player cannot play in accordance with normal rules, he presses the go button 28.

The unit 13 is arranged to calculate for each play the relevant score based upon the cards in play in the areas 14, 15, 18 and 19 together with the additional card in the area 16.

When the playing round is complete in accordance with the normal rules of cribbage, each hand in turn is transferred to the area 17 for a calculation in the conventional melding of the hand. The hand is displayed in this area so that each of the players can view the hand without having to look at each of the player units. As shown in one part of FIG. 1, the player units are shaped so that a player can hold the unit facing towards the player so that display area of that player unit is hidden from the other players. Thus when it is required that the hand be viewed, it is transferred by the unit 13 to the viewing area 17 following which the calculation is made.

After each calculation of a score, the score is entered into the score board 21 in the conventional manner using an electronic display simulating the pegging arrangement.

The game of the present invention has the following advantages.

1. The game adds new excitement to the game by incorporating the computer's logic yet maitaining the tradition, function and appearance of the traditional cribbage game. The game also comes in a variety of visually attractive designs to please all players.

2. The computerized game board will have the capacity to allow one opponent to play against the computer itself, two or three players to compete against each other; or four players to compete as partners.

3. Each player will be equipped with a Control Key Pad which will display up to a maximum of six (6) cards and will consist of seven (7) control key functions which will eliminate the physical functions of the game while maintaining all of the strategies and tactics.

4. The game displays and utilizes, within the computer, a standard deck of 52 playing cards thus eliminating the need for the actual cards.

5. The game incorporates the scoring pegs into the game thus eliminating lost, broken or mismatched pegs. It also eliminates the problem associated with placing the pegs into the tiny holes usually seen on a traditional board.

6. Pegging points are calculated automatically thus eliminating the common errors made in the pegging of points and the tedious physical counting of these points.

7. An illuminating prompt feature has been added to advise the players of the next player's turn.

8. The game allows the novice crib player to play the computer, therefore, adapting the game as a tutorial and advancing his/her level of play.

9. The game allows the advanced crib player to fine tune his/her skill level by playing the pure logic of the computer.

10. Players maintain control over the speed of the game by the "pause" control key which, for example, will allow the novice player to comprehend the points pegged by the cards played or to comprehend the meld (counting of points) in his/her hand at the end of each round.

11. The game maintains the proper order of each players meld thus eliminating the problems associated with "Who Counts First"?

12. The game automatically utilizes the section set aside which indicates the number of games won by each player. This section is seldom utilized on a conventional cribbage board.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for playing the card game Cribbage comprising a central unit, a plurality of player units each having means for connection to the central unit and being separate from the central unit for handling by a respective one of a plurality of players of the card game, said central unit including a processor control means having means for storing indicia representative of each of the cards of a full set of cards, each of said player units including display means for displaying a plurality of said cards selected from the full set of cards, said processor control means including means for simulatively shuffling the set into a substantially random order and means for simulatively dealing the indicia representing individual cards from the set in said random order so as to be displayed onto the display means of each of said player units, with each player unit having displayed thereon different ones of the cards from said set and having manually operable switch means operable by each of the players for transferring selected ones of the displayed indicia from the respective player unit to the central unit for storage thereon, said central unit including a cribbage scoring board having electronic display means thereon for displaying the cribbage score of the players, said central unit including a first display means thereon for displaying a plurality of indicia indicative of the cards from the set transferred from the player units and arranged to constitute the "Crib" of the cribbage game and a plurality of second display units each for displaying a transferred selected one of the displayed indicia from the respective player units, each of the second display means being associated with a respective player unit, sand manually operable switch means including a first crib switch operable to transfer a selected one of the displayed indicia from the respective player unit to said first display means, a second play switch operable to transfer a selected one of the displayed indicia from the respective player unit onto the respective second display means and a third deal switch operable to actuate said dealing means, and means for calculating according to the rules of cribbage the score for each player during play and the score for each player during melding of the indicia displayed on each player unit and means for displaying said calculated score on said cribbage scoring board.

2. The apparatus according to claim 1 wherein said manually operable switch means of each of said player units includes a first pause switch operable to temporarily pause operation of the game, a second shuffle switch operable to actuate sand means for simulatively shuffling on the central unit, a third play switch for actuating transfer of said selected one of the displayed indicia, said play switch being associated with means for selecting a respective one of the displayed indicia on the display means of the respective player unit, a fourth deal switch operable to cause said means for dealing on the central unit to deal the indicia representing the individual cards onto said player units and a fifth cut switch operable to select for the respective player an indicia representative of a selected card from the set to be associated with the player.

* * * * *